US005136964A

United States Patent [19]

Vidovic et al.

[11] Patent Number: 5,136,964

[45] Date of Patent: Aug. 11, 1992

[54] WARNING DEVICE FOR WINDSURFING CRAFT

[75] Inventors: Ninoslav Vidovic; Aleksandra Vidovic, both of Pittsburgh, Pa.; Arnold J. Cook, 5508 Baywood St., Pittsburgh, Pa. 15206

[73] Assignee: Arnold J. Cook, Pittsburgh, Pa.

[21] Appl. No.: 506,592

[22] Filed: Apr. 6, 1990

Related U.S. Application Data

[63] Continuation of Ser. No. 300,337, Jan. 19, 1989, abandoned.

[51] Int. Cl.[5] ..... G08B 21/00

[52] U.S. Cl. ..... 116/26; 114/39.2; 116/142 FP

[58] Field of Search ..... 114/39.2; 441/36; 116/137 R, 142 R, 142 FP, 26

[56] References Cited

U.S. PATENT DOCUMENTS

| | | | |
|---|---|---|---|
| 1,909,828 | 5/1933 | Hueber | 116/142 FV |
| 2,811,129 | 10/1957 | Buell | 116/142 R |
| 3,000,344 | 9/1961 | Ferrell | 116/137 R |
| 3,670,689 | 6/1972 | Pappas | 116/142 FP |
| 3,670,690 | 6/1972 | Swanson | 116/142 FP |
| 3,716,017 | 2/1973 | Greene | 116/137 R |
| 3,785,335 | 1/1974 | Wagner | 116/142 R |
| 3,941,081 | 3/1976 | Nakamura | 116/142 FV |
| 4,044,712 | 8/1977 | Goodman et al. | 116/142 FP |
| 4,227,482 | 10/1980 | Scheindel | 116/142 FP |
| 4,290,043 | 9/1981 | Kaplan | 340/29 |
| 4,402,220 | 9/1983 | Kuhlmann et al. | 116/26 X |
| 4,436,047 | 3/1984 | Freyrie | 114/39.2 X |
| 4,714,914 | 12/1987 | Boe | 340/573 |
| 4,771,723 | 9/1988 | Friesen | 114/39.2 |
| 4,821,670 | 4/1989 | Foxcroft et al. | 116/137 R |
| 4,926,772 | 5/1990 | Bright | 114/39.2 |

OTHER PUBLICATIONS

"Wind Rider" magazine: advertisement for Mast Mate TM emergency kit, publ. Jun. 1990.

*Primary Examiner*—Allan N. Shoap
*Assistant Examiner*—Scott W. Cummings
*Attorney, Agent, or Firm*—Ansel M. Schwartz

[57] ABSTRACT

The present invention pertains to a warning apparatus with respect to a small sailing craft having a structure for holding a sail. The invention is comprised of a device for signaling that does not require the craft to be seen in order for a signal provided by the signaling device to be noticed. The signaling device is attached to the structure. Additionally, there is a device for activating the signaling device so a signal is produced thereby, the activating device is in communication with the signaling device. In a preferred embodiment, the activating device includes a powering device connected to the signaling device; and a device for actuating the powering device so the signaling device receives power to produce the signal.

11 Claims, 5 Drawing Sheets

WARNING DEVICE FOR WINDSURFING CRAFT

This is a continuation of copending application Ser. No. 07/300,337 filed on Jan. 19, 1989.

FIELD OF THE INVENTION

The present invention relates to a warning apparatus for small sailing craft. More specifically, the present invention relates to a warning device that emits a signal from a horn for a windsurfing craft to be noticed.

BACKGROUND OF THE INVENTION

Sailing and in particular windsurfing is becoming a very popular sport, attracting more participants every year. Windsurfing is truly an individual sport which is very enjoyable. However, even the most skillful windsurfer can be overcome by weather conditions. Also, there are a number of situations while windsurfing where there exists the threat of accidental injury due to, for instance, collisions among windsurfers or between windsurfers and other watercrafts, or even between windsurfers and swimmers. In some reported cases, collisions with other watercraft resulted in severe injuries and even death to windsurfers.

Common situations when such incidents occur are, for example, when windsurfers are sailing in an area with heavy watercraft traffic such as a harbor, bay or a small lake during a weekend. The windsurfer observes a watercraft approaching at high speed. If the windsurfer is not able to react fast enough and move from the watercraft's path, and the driver of the watercraft does not observe the windsurfer, then it is almost impossible to avoid collision between the two.

Another situation is when a windsurfer, exhausted by strong wind blowing from shore cannot operate the windsurfing apparatus properly to bring him safely back to shore. This windsurfer may then suffer severe dehydration and sunburns.

So far there have been no proposed devices to assist windsurfers in such situations. The purpose of this invention is to provide windsurfers with an easy and convenient means for warning that can be used in potentially dangerous situations or conditions.

The invention preferably uses horns or whistles operated by pressurized gas. Horns operated by pressurized gas have two main advantages, loudness and insensitivity to the operational conditions, particularly water exposure. Loudness of the sound blasts generated by the compressed gas powered horns makes these devices ideal for outdoor conditions such as large open spaces found on water surfaces. Also loudness and the number of sound blasts are not affected by operational conditions such as temperature.

SUMMARY OF THE INVENTION

The present invention pertains to a warning apparatus with respect to a small sailing craft having a structure for holding a sail. The invention is comprised of means for signaling that does not require the craft to be seen in order for a signal provided by the signaling means to be noticed. The signaling means is attached to the structure. Additionally, there is means for activating the signaling means so a signal is produced thereby, said activating means is in communication with said signaling means.

In a preferred embodiment, the activating means includes powering means connected to the signaling means; and means for actuating the powering means so the signaling means receives power to produce the signal.

BRIEF DESCRIPTION OF THE DRAWINGS

In the accompanying drawings, the preferred embodiments of the invention and preferred methods of practicing the invention are illustrated in which.

DESCRIPTION OF THE PREFERRED EMBODIMENT

Figure 1A:
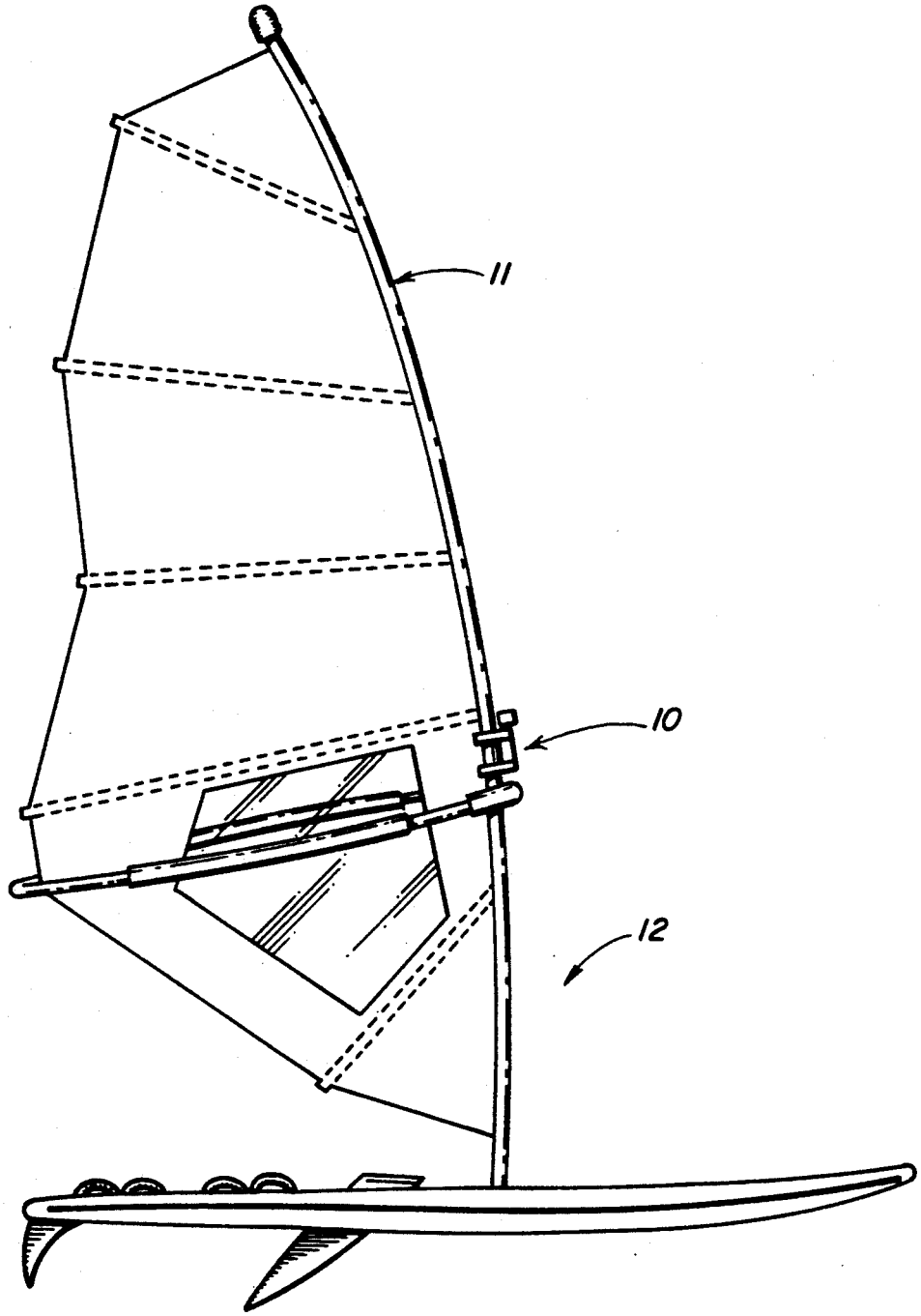
FIG. 1*a* is a perspective view of the warning apparatus with respect to a sailing craft.
Figure 1B:
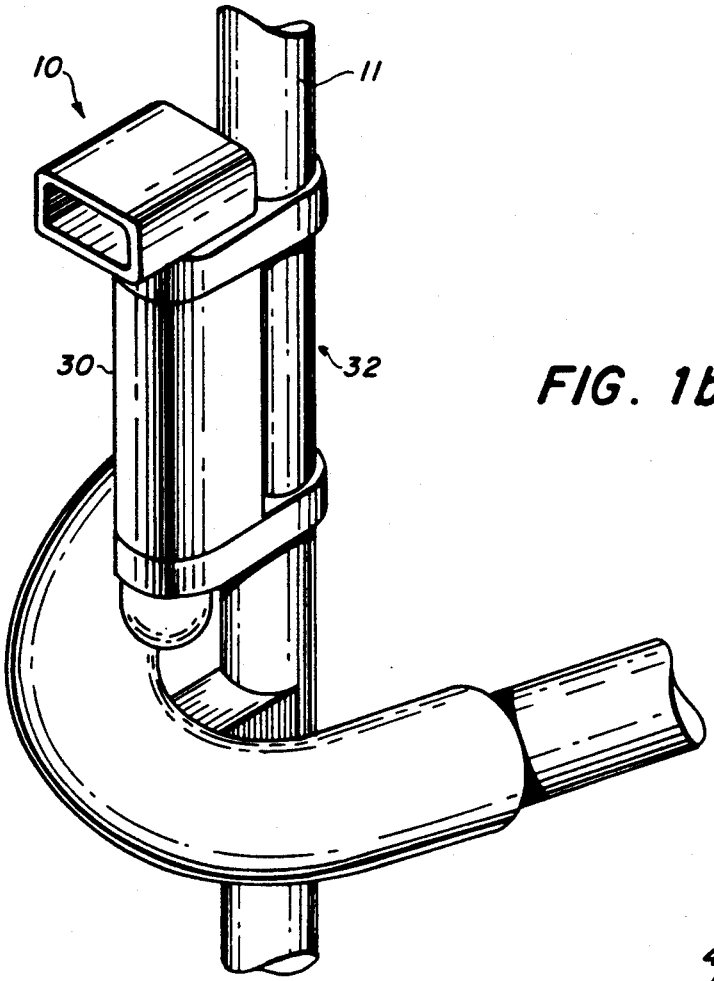
FIG. 1*b* is a perspective view of the warning apparatus on the structure of a sailing craft.

Referring now to the drawings wherein like-reference numerals refer to identical or corresponding parts throughout the several views and more specifically to FIG. 1*a* thereof, there is shown a perspective view of a warning apparatus 10 with respect to a small sailing craft such as a Hoby-Cat TM or preferably a windsurfing craft 12. FIG. 1*b* depicts a more detailed view of the warning apparatus 10. The warning apparatus 10 comprises means for signaling that does not require the craft 12 to be seen in order for a signal provided by the signaling means to be noticed. The signaling means is in juxtaposition with a structure to hold the sail such as a mast 11 of the craft 12. The warning apparatus 10 is also comprised of means for activating the signaling means. The activating means is in communication with the signaling means.

Figure 2:
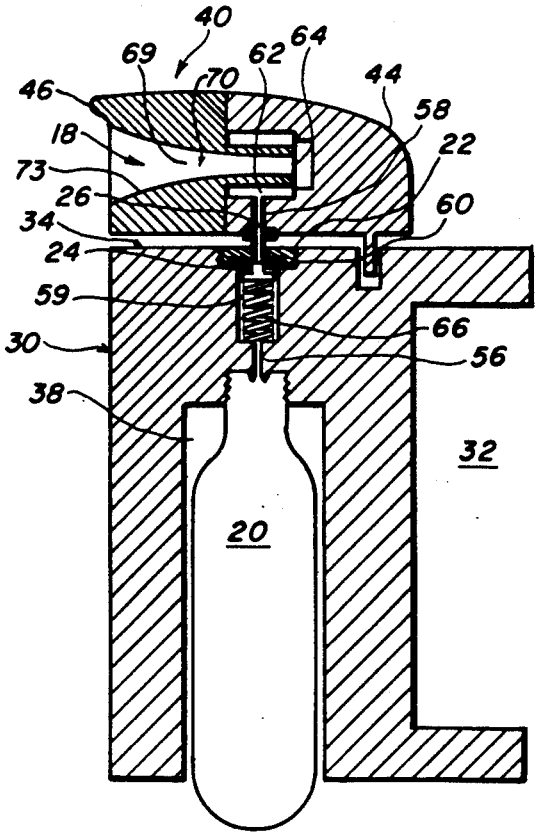
FIG. 2 is a cross-sectional view of the warning apparatus.

The activating means preferably includes means for powering the signaling means and means for actuating the powering means so the signaling means receives power to produce a signal. The warning device 10 is preferably comprised of a first element 30 having a first opening 32 that receives the mast 11 of the craft 12 and a platform 34 at a first side of the first element 30, as shown in FIG. 2. Additionally, the first element 30 includes a second opening 38 disposed essentially parallel to the first opening 32.

The warning device 10 also is comprised of a second element 40 that has the signaling means. The means for actuating the signaling means is disposed between the second element and the first element such that when the second element is forced toward the first element, the actuating means allows the powering means to cause the signaling means to emit a signal. The second element 40 is removably attached to the platform 34. The powering means is controlled by the actuating means to power the signaling means. Preferably, the second element 40 has a first part 44 and a second part 46 which are each removably attachable to the platform 34 and in contact when disposed thereon.

The signaling means is, for instance, a whistle, a siren, or preferably a horn 18 that produces an acoustic signal. The signaling means, however, can also be a light emitting device such as a strobe light or a transmitter or transmitter-receiving device (not shown).

The powering means is, for instance, a battery or preferably a pressurized gas cartridge 20. The gas cartridge 20 is fluidically connected to the horn 18. The actuating means controls when gas from the cartridge 20 passes to the horn 18 to power the horn 18. The powering means is disposed in the second opening 38.

The actuating means can be an electrical circuit that, for instance, allows current to be provided, to an electrically powered device such as a light emitting device (not shown) or preferably a valve 22 when a gas cartridge 20 is used to power the horn 18. The valve 22 preferably has a first portion 24 controlling when gas from the cartridge 20 passes into a second portion 26 of the valve 22 that is connected to the horn 18. When the second element 40 is forced preferably toward the first element 30, the second portion 26 is moved with respect to the first portion 24 and gas from the cartridge 20 is able to pass into the second portion 26 and up to the horn 18.

In the operation of the preferred embodiment, and referring to FIG. 2, a cartridge 20 is inserted into the second opening 38. As the cartridge 20 is seated into the second opening 38, a hollow rod 56 penetrates into the cartridge 20 allowing the pressurized gas to escape into the rod 56. The pressurized gas in the hollow rod 56 is contained by the first portion 24 of the valve 22 in a first channel 59 that is formed in the first element 30. The hollow rod 56 extends from the cartridge 20 to the first channel 59.

When the second element 40 is depressed by a user toward the first element 30, the second portion 26 of the valve 22 is forced to move toward the first channel 59. When this occurs, an opening 60 in the second portion 26 is exposed to the first channel 59, allowing gas in the first channel to enter the second portion 26 of the valve 22.

From the second portion 26, the pressurized gas passes through a second channel 58 to a third channel 62 to diaphragm 64, which is caused to vibrate by the pressurized gas. The vibration of the diaphragm 64 causes an acoustic signal to be produced that can be heard by people in the vicinity of the user. The signal produced by the diaphragm 64 passes out of the warning apparatus 10 via a resonance chamber 73 of the horn 18.

When there is no longer a force depressing the second element 40, a spring 66 causes the second portion 26 of the valve 22 to return to its original position. Pressurized gas is then again contained by the first portion 24 of the valve 22. In this way, the pressurized gas in the cartridge 20 is conserved and the user can produce many signals with the warning device 10 before the gas in the cartridge 20 is exhausted.

Figure 3:
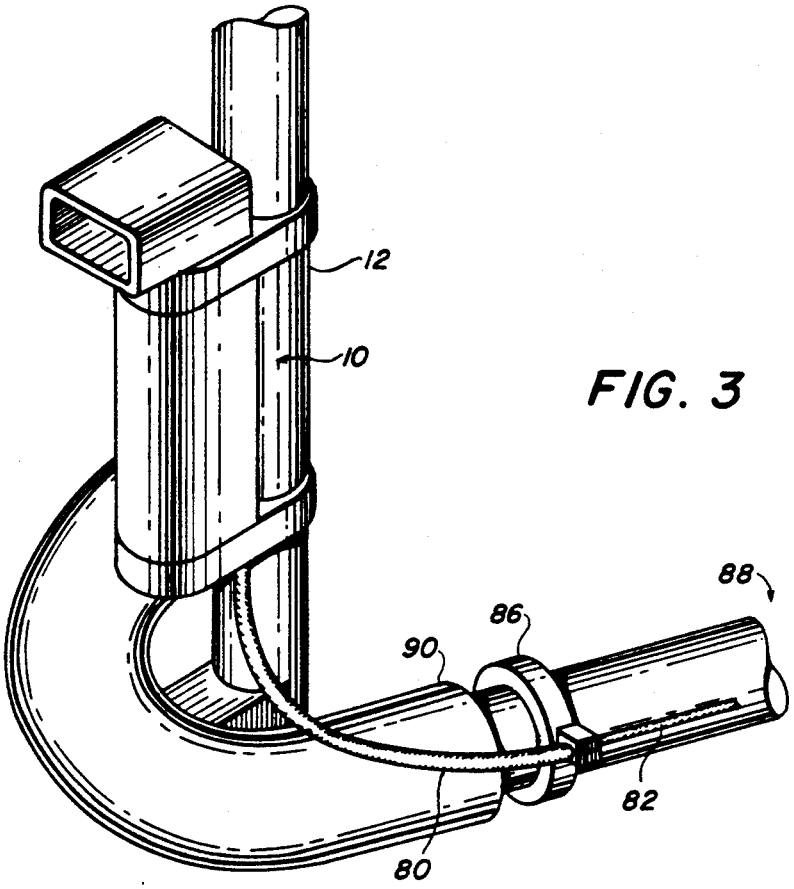
FIG. 3 is a perspective view of an alternative embodiment of the warning apparatus on the structure of a sailing craft.

If, for instance, a user desires to change the pitch of the signal produced by the horn 18 then the second part 46 of the second element 40 can be removed and a different second part 46 with a differently shaped resonance chamber 73 can be attached to the platform 34. This can be accomplished, for instance, by aligning the opening 69 as shown in FIG. 2, of the horn 18 of the second part 46, as shown in FIG. 3, with the opening 70 of the horn 18 of the first part 44, as shown in FIG. 1. Alternatively, the horn 18 of the second part 46 can have a male portion (not shown) that fits into a female portion (not shown) of first part 44 to maximize the passage of the signal produced by the diaphragm 64 of the horn 18.

Similarly, first part 44 of second element can be replaced in a similar fashion as described with the replacement of the second part 46, but also with the second portion 26 being aligned with the second chamber 58.

The cartridge 20 can be replaced by pulling the cartridge 20 away from the first element 30. A new cartridge 20 can then be releasably attached to the first element 30 by snapping the new cartridge into the second opening 38 of the first element 30. As this is done, hollow rod 56 is threaded into the cartridge 20.

Figure 4:
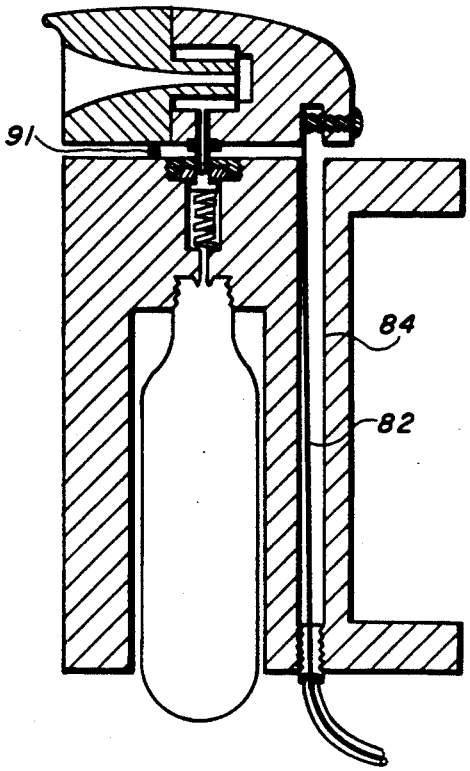
FIG. 4 is a cross-sectional view of the alternative embodiment of the warning apparatus.

Alternatively, the actuating means can be disposed in a third element 80. The third element 80 preferably extends from the first element 30 to a position on the craft 12 that is within easy reach of a user. Referring to FIGS. 3 and 4, the third element 80 is shown in one embodiment as a pull wire 82 which is connected to the second element 40, extends therefrom through a third opening 84 in the first element 30 to a first clamp 86 and a second clamp 88, where it is connected. The first clamp 86 and second clamp 88 are preferably attached to a boom 90 such that a user can easily grasp the pull wire 82 and pull it to cause a signal to be emitted by the horn 18. The third element also preferably has a pivot 91 that is disposed between the first element 30 and second element 40 such that when the pull wire 82 is pulled, the second element 40 pivots around the pivot 90 resulting in the second portion 26 of the valve 22 moving down and exposing the opening 60 to the first channel 59. Pressurized gas is then able to enter the second portion 26 and cause a signal to be emitted by the horn 18 as described above.

Figure 5:
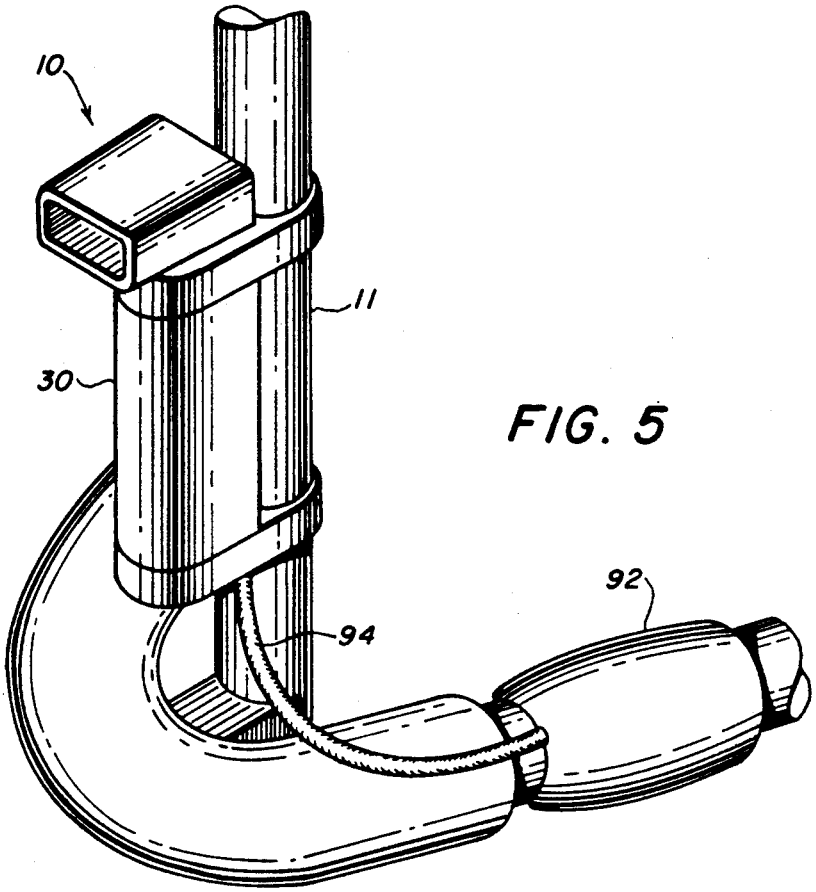
FIG. 5 is a perspective view of a second alternative embodiment of the warning apparatus on the structure of a sailing craft.
Figure 6:
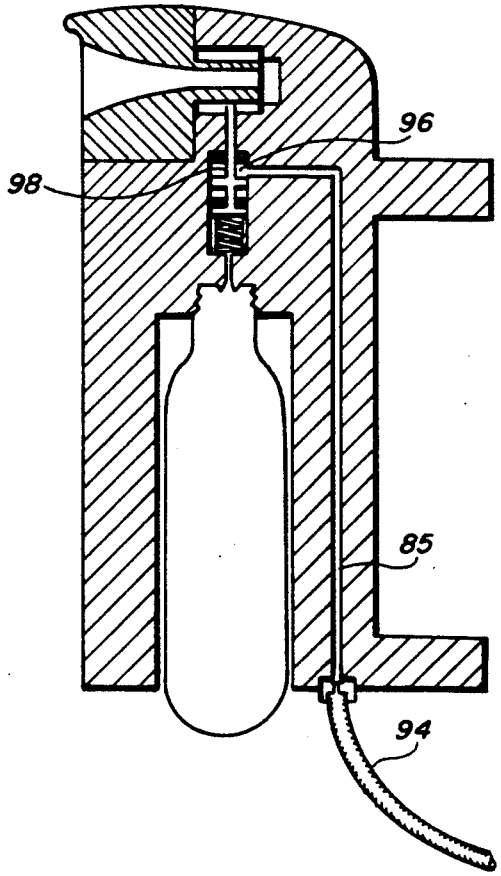
FIG. 6 is a cross-sectional view of the second alternative embodiment of the warning apparatus.

In a preferred embodiment, the third element, as shown in FIG. 5 and 6, is comprised of a squeezable bladder 92 that is preferably positioned about the boom 90 such that a user can easily grasp and squeeze the bladder 92 during the sailing of the craft 12. There is a tube 94 that is fluidically connected to and between the bladder 92 and the first element 30. Preferably, the tube 94 extends into the first element 30 along a third opening 85 of the first element 30 into a recess 96 of first element 30. The first portion 24 of the valve 22 is disposed in the recess 96 and in contact with the first chamber 59. The second portion 26 of the valve 22 has the same design as described above except that the second portion has a second extension 98 disposed in the recess 96 between the first portion 24 and the location 95 where the tube 94 is fluidically connected to the recess 96. The second extension is designed such that fluid forced into the recess 96 via the tube 94 from the user squeezing the bladder 92, acts on the second extension 98, forcing the second portion 26 of the valve 22 down and exposing the opening 60 to the gas in the first chamber 59. The subsequent operation of the valve 22 with respect to the production of a signal by the horn 18 is the same as described above.

Figure 7:
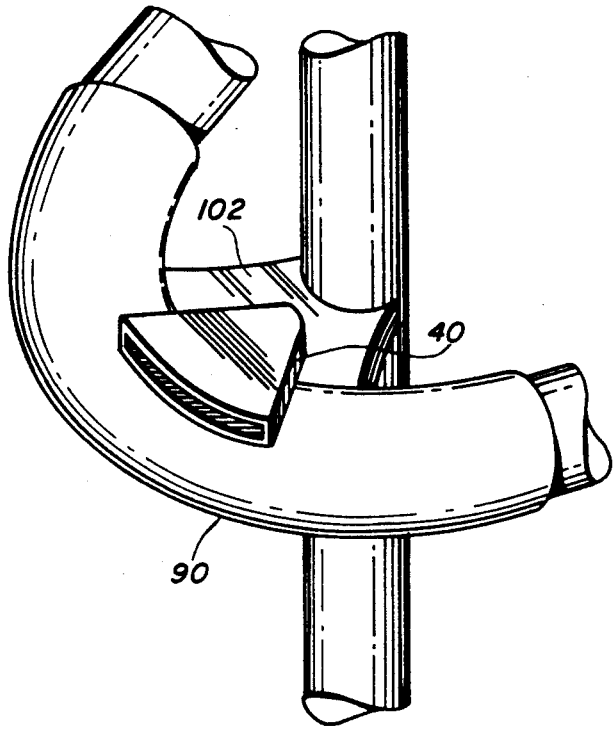
FIG. 7 is a perspective view of a third alternative embodiment of a warning device in the structure of a sailing craft.
Figure 8:
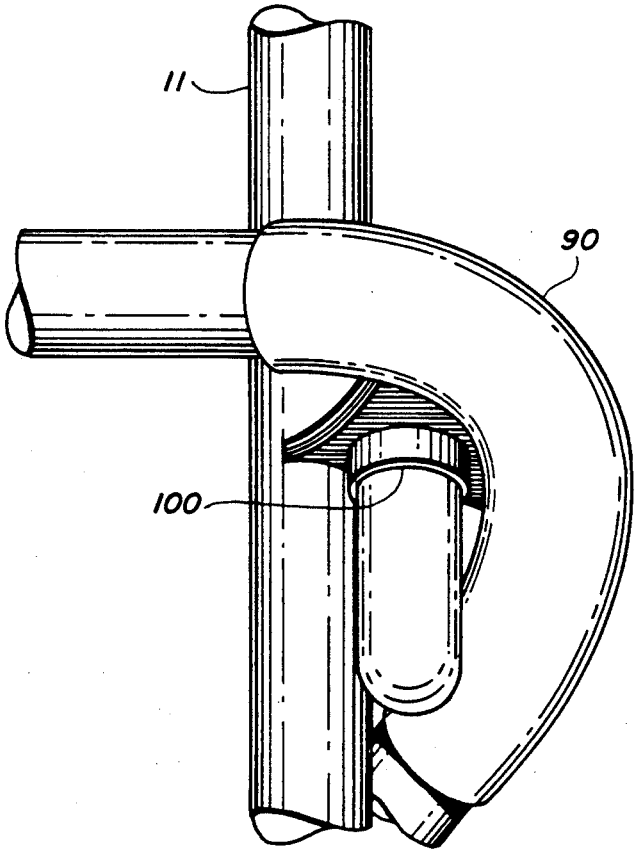
FIG. 8 is a cross-sectional view of the third alternative embodiment.

Instead of the first element 30 having a first opening 32 that receives the mast 11 such that the warning apparatus 10 is held to the structure 12, the warning apparatus 10 can be held in place with respect to the structure 12 by being inserted into an opening 100 in the boom support 102 as shown in FIGS. 7 and 8. Any of the embodiments described above for actuating the warning device 10 can be used in this instance.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A warning apparatus for windsurfing craft having a structure for holding a sail comprising:

means for signaling that does not require the craft to be seen in order for a signal provided by the signaling means to be noticed;

means for attaching the warning apparatus to the windsurfing craft's structure for holding the sail;

means for powering the signaling means so the signaling means receives power to produce the signal;

means for manually actuating the powering means such that each time the actuating means is actuated, the signaling means receive power from the powering means; and said manual actuating means includes a pull wire attached to the structure for holding the sail, said pull wire extending from said actuating means such that when the pull wire is pulled, the powering means powers the signaling means and when the pull wire is released, the signaling means does not receive power.

2. An apparatus as described in claim 1 including:

a first element having a platform at a first end of the first element, and an opening for containing the powering means, said powering means removably attached to the first element; and a second element having the means for signaling, said second element removably attached to the platform, said means for activating the signaling means disposed between the first element and the second element.

3. An apparatus as described in claim 2 wherein the signaling means produces an acoustic signal.

4. An apparatus as described in claim 3 wherein the signaling means if a horn.

5. An apparatus as described in claim 4 wherein the powering means includes a gas cartridge having a pressurized gas which is fluidically connected to the horn, said actuating means controlling when gas from the cartridge passes to the horn to power the horn.

6. An apparatus as described in claim 5 wherein the actuating means includes a valve having a first portion controlling when gas from the cartridge passes to the horn, and a second portion which is fluidically connected to the horn such that when the second element is moved toward the first element the second portion is pushed toward the cartridge and gas is able to pass therethrough.

7. An apparatus as described in claim 6 wherein the actuating means further includes a pivot disposed between the second element and the first element, and the first element includes a third opening through which said pull wire extends from the second element out of the first element such that when the pull wire is pulled, the second element pivots about the pivot and the second portion of the valve is moved toward the cartridge and gas is able to pass therethrough.

8. An apparatus as described in claim 1 wherein the structure for holding the sail includes a boom and a length of the pull wire is attached to the boom with clamps such that the pull wire drapes along a length of the boom.

9. An apparatus as described in claim 8 wherein the signaling means is attached to the structure for holding a sail forward of the clamps.

10. A warning apparatus for windsurfing craft having a structure for holding a sail comprising:

means for signaling that does not require the craft to be seen in order for a signal provided by the signaling means to be noticed;

means for attaching the warning apparatus to the windsurfing craft's structure for holding the sail;

means for powering the signaling means so the signaling means receives power to produce the signal;

means for manually actuating the powering means such that each time the actuating means is actuated, the signaling means receive power from the powering means;

a first element having a platform at a first end of the first element, and an opening for containing the powering means, said powering means removably attached to the first element; and a second element having the means for signaling, said second element removably attached to the platform, said means for actuating the signaling means disposed between the first element and the second element.

11. An apparatus as described in claim 10 wherein the powering means is a gas cartridge.

* * * * *